US010179680B2

(12) United States Patent
Kim

(10) Patent No.: US 10,179,680 B2
(45) Date of Patent: Jan. 15, 2019

(54) TUBE-TYPE COSMETICS CONTAINER FOR DISCHARGING LIQUID CONTENTS IN FORM OF DROPLET

(71) Applicant: YONWOO CO., LTD., Incheon (KR)

(72) Inventor: Sung-Hwan Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 15/031,977

(22) PCT Filed: Jul. 25, 2014

(86) PCT No.: PCT/KR2014/006821
§ 371 (c)(1),
(2) Date: Apr. 25, 2016

(87) PCT Pub. No.: WO2015/088120
PCT Pub. Date: Jun. 18, 2015

(65) Prior Publication Data

US 2016/0272381 A1 Sep. 22, 2016

(30) Foreign Application Priority Data

Dec. 10, 2013 (KR) ..... 10-2013-0152703

(51) Int. Cl.
*B65D 47/18* (2006.01)
*A45D 34/00* (2006.01)
*A45D 34/04* (2006.01)
*B65D 47/12* (2006.01)

(52) U.S. Cl.
CPC ..... *B65D 47/18* (2013.01); *A45D 34/00* (2013.01); *A45D 34/04* (2013.01); *B65D 47/121* (2013.01); *A45D 2200/054* (2013.01); *B65D 2547/066* (2013.01)

(58) Field of Classification Search
CPC ..... B65D 47/18; B65D 47/121
USPC ..... 222/420
See application file for complete search history.

(56) References Cited

U.S. PATENT DOCUMENTS

| | | | | |
|---|---|---|---|---|
| 6,197,008 | B1 | 3/2001 | Hagele | |
| 7,178,703 | B2 | 2/2007 | Spada et al. | |
| 2004/0050881 | A1* | 3/2004 | Deussen | B65D 47/18 222/420 |
| 2004/0140319 | A1* | 7/2004 | Gerondale | A61F 9/0008 222/1 |

(Continued)

FOREIGN PATENT DOCUMENTS

| | | | |
|---|---|---|---|
| KR | 20-0310084 | Y1 | 4/2003 |
| WO | WO-01-08993 | A1 | 2/2001 |
| WO | WO-2010-102207 | A2 | 9/2010 |

OTHER PUBLICATIONS

International Search Report issued in PCT/KR2014/006821 dated Nov. 12, 2014.

*Primary Examiner* — Jeremy Carroll
(74) *Attorney, Agent, or Firm* — Marshall, Gerstein & Borun LLP

(57) ABSTRACT

Provided is a tube-type cosmetic container which discharges a liquid content in a form of droplet. The tube-type cosmetic container reduces the cost burden in accordance with shortening of the manufacturing time and reducing cost, by allowing a liquid content to be discharged in a form of droplet through a simple content discharging structure that becomes gradually wider from a lower portion to an upper portion thereof.

5 Claims, 3 Drawing Sheets

(56) References Cited

U.S. PATENT DOCUMENTS

| | | | | |
|---|---|---|---|---|
| 2005/0274744 | A1* | 12/2005 | Spada | B65D 47/18 222/240 |
| 2008/0209857 | A1* | 9/2008 | Morini | B65B 55/04 53/281 |
| 2011/0144598 | A1* | 6/2011 | Mihashi | A61F 9/0008 604/295 |
| 2011/0297703 | A1* | 12/2011 | Wilson | B65D 47/18 222/212 |
| 2013/0221015 | A1* | 8/2013 | Schmidt | B29C 45/16 220/789 |
| 2015/0158050 | A1* | 6/2015 | Atwell | B05C 17/00516 222/420 |

* cited by examiner

[Fig. 1]
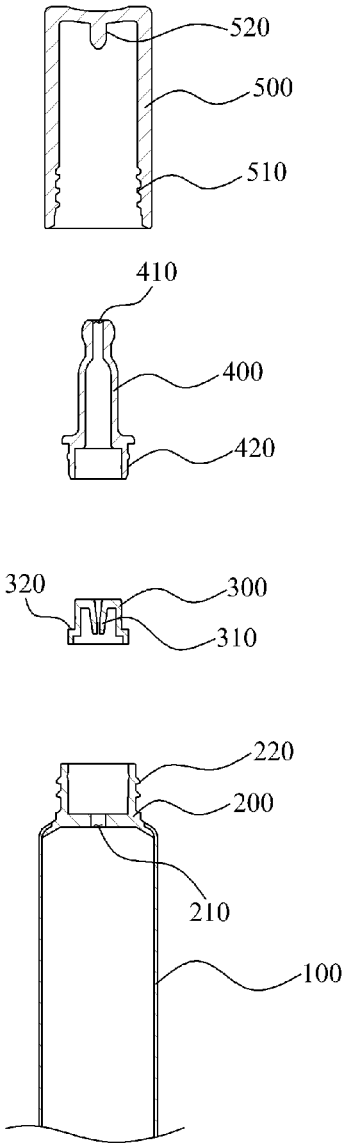

[Fig. 2]
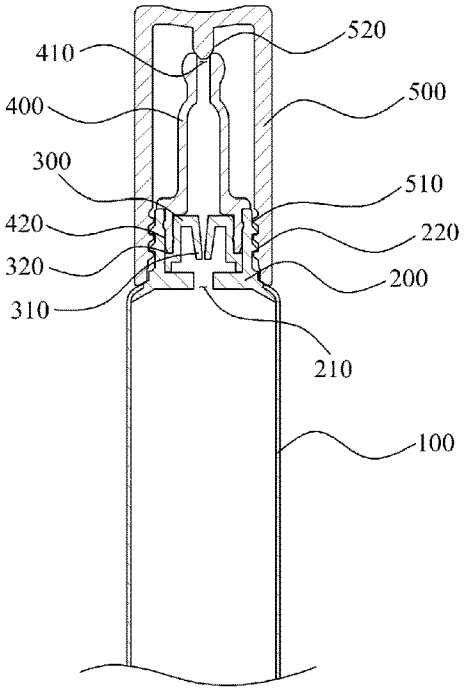
[Fig. 3]
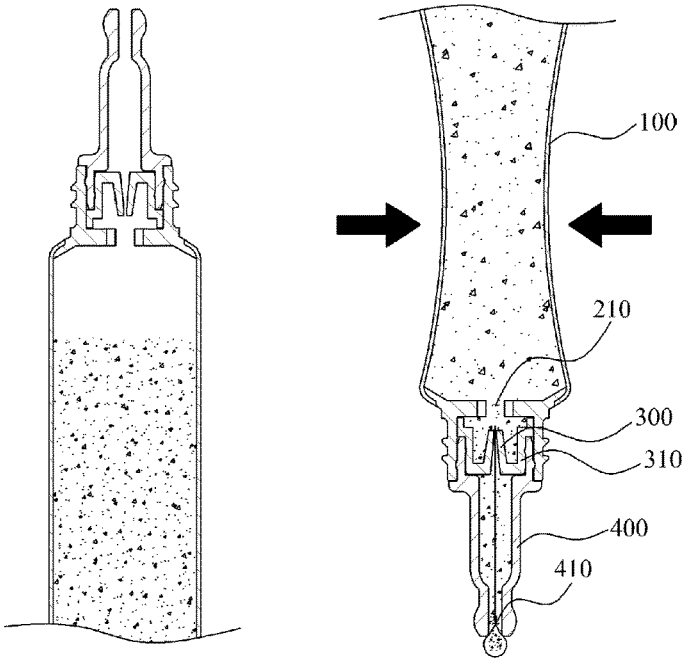
(a) (b)

[Fig. 4]
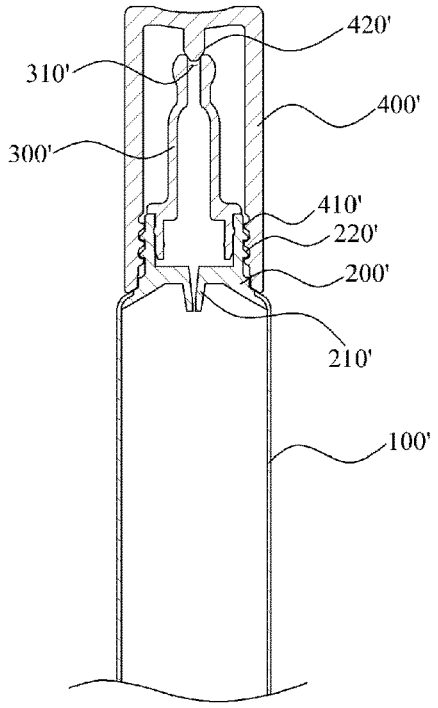
[Fig. 5]
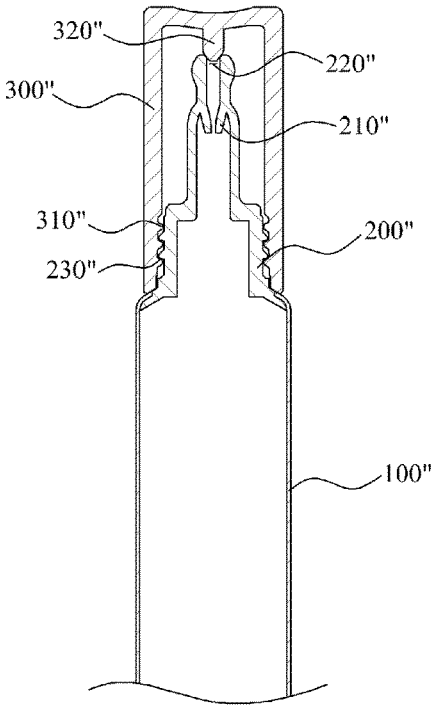

TUBE-TYPE COSMETICS CONTAINER FOR DISCHARGING LIQUID CONTENTS IN FORM OF DROPLET

CROSS-REFERENCE TO RELATED APPLICATIONS

This U.S. utility patent application is a national stage application under 35 U.S.C. § 371 of international application PCT/KR2014/006821, filed Jul. 25, 2014, and claims the benefit of priority under 35 U.S.C. § 119 of Korean Patent Application No. 10-2013-0152703, filed Dec. 10, 2013, the entire contents of which are hereby incorporated herein by reference for all purposes.

TECHNICAL FIELD

The following disclosure relates to a tube-type cosmetic container which discharges a liquid content in a form of droplet, and more particularly, to a tube-type cosmetic container which can reduce the cost burden in accordance with shortening of the manufacturing time and reducing cost, by allowing a liquid content to be discharged in a form of droplet through a simple content discharging structure that becomes gradually wider from a lower portion to an upper portion thereof.

BACKGROUND

Generally, liquid medicine and artificial tears which are dripped in the eyes for use are contained in a tube-type container and are provided. When a user pressurizes the tube-type container, liquid contents are uniformly discharged in a form of droplet.

For example, a tube-type cosmetic container for discharging a liquid content in a form of droplet is disclosed in Korean Utility Model No. 20-0310084 (hereinafter, referred to as "Korean Utility Model").

Korean Utility Model relates to a tube-type cosmetic container in which a discharge port coupling cap (3) having a discharge hole (3a) is coupled to a discharge port (2) formed on the front end of a tube container (1), and a cap (4) is disposed on and coupled to the discharge port coupling cap (3). Also, a first discharge tube (5) having a discharge hole (5a) is inserted into the discharge port coupling cap (3), and an intermediate outlet tube (6) including a straight-line cutout (6a) at the upper portion thereof and formed of a rubber material is inserted into the first discharge tube (5). Also, an outlet tube (7) having a tube-type shape is inserted into the intermediate outlet tube (6). The outlet tube (7) includes a flange (7b) on a lower portion thereof so as to be stopped by a circular stopper (2a) formed in the discharge port (2) of the tube container (1), and has a discharge hole (7c) formed at a center thereof and communicating with the tube container (1).

In Korean Utility Model, when the tube container (1) is pressurized by a certain force, contents inside the container move through the discharge hole (7c) of the outlet tube (7), and collect in a space (9). At the same time, the cutout (6a) of the intermediate outlet tube (6) surrounding the outlet tube (7) spreads out, and thus a straight-line gap is generated. In this case, liquid contents collected in the space (9) are converted into a form of droplet while being discharged through the straight-line gap, and are discharged through the discharge hole (5a) of the first discharge tube (5). However, since the structure of Korean Utility Model for discharging contents in a form of droplet is complicated, the manufacturing time and cost increase, thereby causing a cost burden of a user.

SUMMARY OF THE DISCLOSURE

Accordingly, the present disclosure provides a tube-type cosmetic container which can reduce the cost burden in accordance with shortening of the manufacturing time and reducing cost, by allowing a liquid content to be discharged in a form of droplet through a simple content discharging structure that becomes gradually wider from a lower portion to an upper portion thereof.

In one general aspect, a tube-type cosmetic container for discharging liquid contents in a form of droplet, the container including: a tube body 100 storing contents; a tube neck 200 coupled to an upper portion of the tube body 100 to support the tube body 100 and having an outlet hole 210 such that contents stored in the tube body 100 are discharged therethrough; a discharge control part 300 coupled to an inner side of the tube neck 200 and including a discharge control tube 310 which gradually becomes wider from a lower portion to an upper portion of the discharge control tube 310 so as to control an amount of discharge when contents discharged through the outlet hole 210 move upward; a content discharging tube 400 coupled to an upper portion of the tube neck 200, pressurizing the discharge control part 300 to fix the discharge control part 300 to an inner side of the tube neck 200, and having a discharge hole 410 formed on an upper end of the content discharging tube 400 to discharge contents out of the content discharging tube 400; and an over cap 500 coupled to the tube neck 200 while covering an outer side of the tube neck 200, and including a closing rod 520 so as to close the discharge hole 410 of the content discharging tube 400.

The discharge control part 300 may include a seating stopper 320 surrounding an outer circumferential surface of the discharge control part 300 such that a lower portion of the content discharging tube 400 is seated on the seating stopper 320, and the content discharging tube 400 may include a seating protrusion 420 formed at the lower portion of the content discharging tube 400 and seated on the seating stopper 320.

In another general aspect, a tube-type cosmetic container for discharging liquid contents in a form of droplet includes: a tube body 100' storing contents; a tube neck 200' coupled to an upper portion of the tube body 100' to support the tube body 100' and including a discharge control tube 210' which gradually becomes wider from a lower portion to an upper portion of the discharge control tube 210' so as to control an amount of discharge of content stored in the tube body 100' when contents are discharged by pressurization of the tube body 100'; a content discharging tube 300' coupled to an upper portion of the tube neck 200' and having a discharge hole 310' formed on an upper end of the content discharging tube 300' so as to discharge contents moving upward through the discharge control tube 210' out of the content discharging tube 300'; and an over cap 400' coupled to the tube neck 200' while covering an outer side of the tube neck 200', and including a closing rod 420' so as to close the discharge hole 310' of the content discharging tube 300'.

In another general aspect, a tube-type cosmetic container for discharging liquid contents in a form of droplet includes: a tube body 100") storing contents; a content discharging tube 200') coupled to an upper portion of the tube body 100" to support the tube body 100", including a discharge control tube 210" which gradually becomes wider from a lower portion to an upper portion of the discharge control tube 210" so as to control an amount of discharge of content stored in the tube body 100" when contents are discharged by pressurization of the tube body 100", and having a discharge hole 220" formed on an upper end of the content discharging tube 200" so as to discharge contents moving upward through the discharge control tube 210" out of the content discharging tube 200"; and an over cap 300" coupled to the content discharging tube 200" while covering an outer side of the content discharging tube 200", and including a closing rod 320" so as to close the discharge hole 220" of the content discharging tube 200".

The discharge control tube 210" may downwardly extend while surrounding an inner circumferential surface of the content discharging tube 200" at an inner side of an upper portion of the content discharging tube 200".

Other features and aspects will be apparent from the following detailed description, the drawings, and the claims.

According to an embodiment of the present disclosure, a tube-type cosmetic container can reduce the cost burden in accordance with shortening of the manufacturing time and reducing cost, by allowing a liquid content to be discharged in a form of droplet through a simple content discharging structure that becomes gradually wider from a lower portion to an upper portion thereof.

BRIEF DESCRIPTION OF DRAWINGS

FIG. 1 is an exploded cross-sectional view illustrating a configuration of a tube-type cosmetic container for discharging liquid contents in a form of droplet according to a first embodiment of the present disclosure.

FIG. 2 is an assembled cross-sectional view illustrating a configuration of a tube-type cosmetic container for discharging liquid contents in a form of droplet according to a first embodiment of the present disclosure.

FIG. 3 is a view illustrating a use state of a tube-type cosmetic container for discharging liquid contents in a form of droplet according to a first embodiment of the present disclosure.

FIG. 4 is an assembled cross-sectional view illustrating a configuration of a tube-type cosmetic container for discharging liquid contents in a form of droplet according to a second embodiment of the present disclosure.

FIG. 5 is an assembled cross-sectional view illustrating a configuration of a tube-type cosmetic container for discharging liquid contents in a form of droplet according to a third embodiment of the present disclosure.

DETAILED DESCRIPTION

Hereinafter, exemplary embodiments of the present disclosure will be described in detail with reference to the accompanying drawings. The same reference numerals provided in the drawings indicate the same members.

FIG. 1 is an exploded cross-sectional view illustrating a configuration of a tube-type cosmetic container for discharging liquid contents in a form of droplet according to a first embodiment of the present disclosure. FIG. 2 is an assembled cross-sectional view illustrating a configuration of a tube-type cosmetic container for discharging liquid contents in a form of droplet according to a first embodiment of the present disclosure. FIG. 3 is a view illustrating a use state of a tube-type cosmetic container for discharging liquid contents in a form of droplet according to a first embodiment of the present disclosure.

Referring to FIGS. 1 to 3, a tube-type cosmetic container for discharging liquid contents in a form of droplet according to an exemplary embodiment of the present disclosure may include a tube body 100, a tube neck 200, a discharge control part 300, a content discharging tube 400, and an over cap 500.

The tube body 100 may store liquid contents, and may be formed of a flexible material so as to enable contents to be discharged by pressurization of a user.

The tube neck 200 may be coupled to an upper portion of the tube body 100 to support the tube body 100, and may have an outlet hole 210 formed at a central portion thereof such that contents stored in the tube body 100 can be discharged therethrough.

The tube neck 200 may have a first screw thread 220 which is formed on an upper outer circumferential surface of the tube neck 200 and through which the over cap 500 is screw-coupled to the tube neck 200.

The discharge control part 300 may be coupled to the inner side of the tube neck 200, and may control the amount of discharge when contents discharged through the outlet hole 210 move upward. In some implementations, the discharge control part 300 may include a discharge control tube 310 that is disposed at a central portion thereof and becomes gradually wider from the lower portion to the upper portion thereof.

The discharge control tube 310 may downwardly extend from the central portion of the upper end of the discharge control part 300 to control the amount of discharge of contents, and may become gradually wider from the lower portion to the upper portion thereof, enabling contents to drip down in a form of droplet.

As show in FIG. 3 which illustrates a process of dripping down contents, when a user turns the tube body 100 upside down and then pressurizes the tube body 100, a very small amount of contents among contents discharged through the outlet hole 210 may pass through a narrow lower portion of the discharge control tube 310 to be filled in the content discharging tube 400. When the filling of content in the content discharging tube 400 is completed and a certain amount of contents continuously passes the narrow lower portion of the discharge control tube 310, contents gather in a discharge hole 410 of the content discharging tube 400, and then may be discharged in a form of droplet.

On the other hand, a seating stopper 320 may be formed to surround the outer circumferential surface of the discharge control part 300 such that a seating protrusion 420 formed at a lower portion of the content discharging tube 400 described later is seated on the seating stopper 320.

The content discharging tube 400 may be coupled to the upper portion of the tube neck 200 to discharge contents to the outside, and may have the discharge hole 410 formed on the upper end thereof so as to allow contents to be discharged therethrough.

In some implementations, the content discharging tube 400 may pressurize the discharge control part 300 to allow the discharge control part 300 to be fixed in the tube neck 200. To this end, the seating protrusion 420 may be formed on the lower portion of the content discharging tube 400 to be seated on the seating stopper 320.

The over cap 500 may be detachably coupled to the tube neck 200 while covering the outer side of the tube neck 200, and may have a second screw thread 510 formed on the inner circumferential surface thereof so as to be screw-coupled to the first screw thread 220 of the tube neck 200.

Also, a closing rod 520 may be provided on the undersurface of the upper end of the over cap 500 to close the discharge hole 410 of the content discharging tube 400 and thus prevent leakage of contents.

Hereinafter, a tube-type cosmetic container for discharging liquid contents in a form of droplet according to a second embodiment of the present disclosure will be described in detail with reference to FIG. 4.

Referring to FIG. 4, a tube-type cosmetic container for discharging liquid contents in a form of droplet according to a second embodiment of the present disclosure may not include the discharge control part 300 for controlling the amount of discharge of contents unlike the first embodiment, and may include a discharge control tube 210' at a central portion of a tube neck 200'. The discharge control tube 210' may be integrally formed so as to become wider from a lower portion to an upper portion of the tube neck 200'. Thus, since the discharge control part 300 need not be coupled to the inner side of the tube neck 200, the number of parts and the assembly time can be reduced, thereby improving the productivity.

On the other hand, since a tube body 100', a content discharging tube 300', and an over cap 400' are the same as those described in the first embodiment, a detailed description thereof will be omitted herein.

Hereinafter, a tube-type cosmetic container for discharging liquid contents in a form of droplet according to a third embodiment of the present disclosure will be described in detail with reference to FIG. 5.

Referring to FIG. 5, a tube-type cosmetic container for discharging liquid contents in a form of droplet according to a third embodiment of the present disclosure may not include the tube neck 200 supporting the tube body 100 and having the outlet hole 210 unlike the first embodiment, and may include a content discharging tube 200" integrally formed on an upper portion of a tube body 100" storing contents and discharging contents out of the tube body 100". The content discharging tube 200" may be directly formed integrally with the tube body 100". Accordingly, unlike the first embodiment, since processes of forming the tube neck 200 on the tube body 100 and coupling the content discharging tube 400 to the tube neck 200 are not need, the number of parts and the assembly time can be reduced, thereby improving the productivity.

On the other hand, a discharge control tube 210" may be provided at an inner side of the upper portion of the content discharging tube 200". The discharge control tube 210" may downwardly extend while surrounding the inner circumferential surface of the content discharging tube 200" to control the amount of discharge of contents. The discharge control tube 210" may be formed directly on an inner side of the content discharging tube 200" so as to become wider from a lower portion to an upper portion of discharge control tube 210". Accordingly, unlike the first embodiment, since the discharge control part 300 need not be coupled to the inner side of the tube neck 200, the number of parts and the assembly time can be reduced, thereby improving the productivity.

Also, a discharge hole 220" may be formed on the upper end of the content discharging tube 200" to discharge contents moving upward through the discharge control tube 210" out of the content discharging tube 200". In addition, an over cap 300" provided with a closing rod 320" may be coupled to the outer side of the content discharging tube 200" to close the discharge hole 220".

As described above, optimal embodiments have been disclosed in the drawings and the specification. Although specific terms have been used herein, these are only intended to describe the present disclosure and are not intended to limit the meanings of the terms or to restrict the scope of the present disclosure as disclosed in the accompanying claims. Therefore, those skilled in the art will appreciate that various modifications and other equivalent embodiments are possible from the above embodiments. Accordingly, the scope of the present disclosure should be defined by the technical spirit of the accompanying claims.

The invention claimed is:

1. A tube-type cosmetic container for discharging liquid contents in a form of droplets, the container comprising:

a tube body storing contents;

a tube neck coupled to an upper portion of the tube body to support the tube body and having an outlet hole such that contents stored in the tube body are discharged therethrough;

a discharge control part coupled to an inner side of the tube neck and comprising a discharge control tube which gradually becomes wider from a lower portion to an upper portion of the discharge control tube so as to control an amount of discharge when contents discharged through the outlet hole move upward;

a content discharging tube directly coupled to an upper portion of the tube neck, wherein the content discharge tube presses the discharge control part downwards to fix the discharge control part to an inner side of the tube neck, and having a discharge hole formed on an upper end of the content discharging tube; and an over cap coupled to the tube neck while covering an outer side of the tube neck, and comprising a closing rod so as to close the discharge hole of the content discharging tube, wherein the content discharging tube is configured with a lower portion and an upper portion, which has a narrower diameter than the lower portion and extends from the lower portion to the discharge hole, such that when the tube body is pressurized, contents filled in the inside of the content discharging tube through the discharge control tube, while being discharged through the discharge hole, pass through the upper portion of the content discharging tube, and are discharged out of the container in a form of droplets, wherein the lower portion of the content discharging tube is disposed radially inwardly of the inner side of the tube neck between the tube neck and the discharge control part, wherein the discharge control part is entirely disposed radially inwardly of the tube neck, and wherein the over cap directly engages the tube neck.

2. The tube-type cosmetic container of claim 1, wherein the discharge control part comprises a seating stopper surrounding an outer circumferential surface of the discharge control part such that a lower portion of the content discharging tube is seated on the seating stopper, and the content discharging tube comprises a seating protrusion formed at the lower portion of the content discharging tube and seated on the seating stopper.

3. The tube-type cosmetic container of claim 1, wherein the content discharging tube is directly coupled to the upper portion of the tube neck.

4. A tube-type cosmetic container for discharging liquid contents in a form of droplets, the container comprising:

a tube body storing contents;

a tube neck coupled to an upper portion of the tube body to support the tube body and comprising a discharge control tube which gradually becomes wider from a lower portion toward an upper portion of the discharge control tube so as to control an amount of discharge of content stored in the tube body when contents are discharged by pressurization of the tube body;

a content discharging tube coupled to an upper portion of the tube neck and having a discharge hole formed on an upper end of the content discharging tube so as to discharge contents moving upward through the discharge control tube out of the content discharging tube; and an over cap coupled to the tube neck while covering an outer side of the tube neck, and comprising a closing rod so as to close the discharge hole of the content discharging tube, wherein the content discharging tube has a lower portion and an upper portion, which has a narrower diameter than the lower portion and extends from the lower portion to the discharge hole, such that when the tube body is pressurized, contents filled in the inside of the content discharging tube through the discharge control tube, while being discharged through the discharge hole, pass through the upper portion of the content discharging tube formed with a narrow diameter, and are discharged out of the container in a form of droplets, wherein the discharge control tube is structurally separate from the content discharging tube, wherein the discharge control tube is integrally formed with the tube neck and extends into an interior of the tube body, and wherein the over cap directly engages the tube neck.

5. The tube-type cosmetic container of claim 4, wherein the discharge control tube is an integral part of the tube neck.

* * * * *